US008721050B2

(12) United States Patent
Ishida et al.

(10) Patent No.: US 8,721,050 B2
(45) Date of Patent: May 13, 2014

(54) LIQUID DISCHARGE HEAD WITH PROTECTIVE LAYER AND LIQUID DISCHARGE DEVICE

(71) Applicant: Canon Kabushiki Kaisha, Tokyo (JP)

(72) Inventors: Yuzuru Ishida, Yokohama (JP); Maki Kato, Fuchu (JP); Kenji Takahashi, Yokohama (JP); Ichiro Saito, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/693,845

(22) Filed: Dec. 4, 2012

(65) Prior Publication Data

US 2013/0141494 A1 Jun. 6, 2013

(30) Foreign Application Priority Data

Dec. 6, 2011 (JP) ..... 2011-267153

(51) Int. Cl.
*B41J 2/05* (2006.01)

(52) U.S. Cl.
USPC ..... 347/64; 347/56; 347/63

(58) Field of Classification Search
USPC ..... 347/20, 22, 23, 26, 56, 61–65, 67
See application file for complete search history.

(56) References Cited

U.S. PATENT DOCUMENTS 5,455,612 A * 10/1995 Ikeda et al. ..... 347/64

FOREIGN PATENT DOCUMENTS

JP 2008-105364 A 5/2008

* cited by examiner

*Primary Examiner* — Juanita D Jackson
(74) *Attorney, Agent, or Firm* — Canon U.S.A., Inc., IP Division

(57) ABSTRACT

A liquid discharge head, contains: an energy generating element which generates thermal energy and contains a heat generation resistant layer and a pair of electrode layers whose end surfaces are separated from each other; an insulating layer covering the pair of electrode layers and the heat generation resistant layer and containing an insulating material; a protective layer provided above the insulating layer at least at a position corresponding to the energy generating element and containing a metal material containing iridium or ruthenium; and a covering layer provided at a position covering at least portions of the protective layer corresponding to the end surfaces of the pair of electrode layers in such a manner that a part of the protective layer is exposed and containing a metal material containing tantalum or niobium.

19 Claims, 7 Drawing Sheets

LIQUID DISCHARGE HEAD WITH PROTECTIVE LAYER AND LIQUID DISCHARGE DEVICE

BACKGROUND OF THE INVENTION

1. Field of the Invention

The present invention relates to a liquid discharge head and a liquid discharge device.

2. Description of the Related Art

A liquid discharge head for use in inkjet recording has a plurality of discharge ports and a plurality of energy generating elements for generating thermal energy to be utilized for discharging ink from the discharge ports. Such an energy generating element contains a heat generation resistant layer and an electrode for supplying electric power to the resistant layer. By covering the energy generating element with an insulating layer containing an insulating material, insulation between the ink and the energy generating element is secured. The ink is sharply heated by thermal energy generated by driving such energy generating elements, whereby the ink undergoes film boiling, so that bubbles are formed. Then, the ink is discharged to a recording medium by pressure accompanied with these bubbles, and thus recording is performed.

A heat acting portion in which the heat generated by the energy generating elements is transmitted to the ink is subjected to high temperature due to heating of the heat generation resistant layer and also subjected in a complex manner to a physical action, such as impact of cavitation accompanied with expansion and contraction of bubbles and a chemical action by the ink. Therefore, in order to protect the energy generating element and the insulating layer, a protective layer is provided at a position corresponding to the energy generating element. Usable as a material of such a protective film are tantalum and a platinum group (iridium, ruthenium, and the like) resistant to the impact caused by cavitation and the chemical action caused by ink. In particular, a film of the platinum group, such as iridium and ruthenium, is a very stable film and the film has resistance to ink and has strong resistance to the impact caused by cavitation. Therefore, the materials are useful from the viewpoint of reliability and extension of life-span of the head.

However, it is known that such materials are hardly chipped even when cavitation arises, and therefore a hardly-soluble substance (kogation) generated due to thermal decomposition of a substance in ink is likely to adhere to the surface of the protective layer, and is gradually deposited. When such kogation adheres to the heat acting portion, the energy generated by the energy generating element is not sufficiently transmitted to ink, resulting in unstable discharge.

Japanese Patent Laid-Open No. 2008-105364 discloses applying a voltage to the protective layer to cause an electrochemical reaction between the ink and the protective layer to elute about several nanometers of the surface of the protective layer to thereby remove the kogation deposited on the protective layer. FIG. 7 is a cross-sectional schematic view of the periphery of an energy generating element of a liquid discharge head of Japanese Patent Laid-Open No. 2008-105364. An energy generating element 1108 contains a heat generation resistant layer 1104 and an electrode layer 1105 is covered with an insulating layer 1106 containing a silicon nitride film or the like. At the position corresponding to the energy generating element 1108, a protective layer 1107 containing iridium and ruthenium and a wiring layer 1109 supplying electric power to the protective layer 1107 are provided. It is disclosed that kogation deposited on the energy generating element 1108 can be removed by applying a voltage in such a manner that the protective layer 1107 serves as an anode using the wiring layer 1109 and a counter electrode 1111 to elute about several nanometers of the surface of the protective layer 1107.

However, as is understood from FIG. 7, the surface of the insulating layer 1106 corresponding to the energy generating element 1108 of the liquid discharge head disclosed in Japanese Patent Laid-Open No. 2008-105364 has a convexo-concave shape due to the electrode layer 1105. Since the protective layer 1107 is generally formed using a film formation technique, such as a sputtering method, the film thickness becomes small at a level difference portion or an inclined portion. More specifically, the film thickness of the protective layer 1107 at the position corresponding to the boundary portions of the electrode layer 1105 and the heat generation resistant layer 1104 (hereinafter also referred to as a tapered portion) is smaller than that of a flat portion above the energy generating element, and the film thickness is only about 50 to 60% of the film thickness of a region above the energy generating element. The film quality of the boundary portions, i.e., the tapered portions of the protective layer 1107 corresponding to the end surfaces apart from each other of a pair of electrode layers 1105, is bad as compared with the film quality of the flat portion.

When a kogation removal operation is performed using such a liquid discharge head, an electrochemical reaction rapidly proceeds in the protective layer of the portions corresponding to the boundary portions, so that the protective layer of the portions is very rapidly eluted. Therefore, when the kogation removal operation is repeated, the film thickness of the protective layer at the portions corresponding to the boundary portions is further reduced as compared with the film thickness of the flat portion. Therefore, a crack and the like arise due to cavitation in the protective layer with the tapered portions as the starting point, which causes a problem such that the energy generating element cannot be sufficiently protected.

SUMMARY OF THE INVENTION

The present invention provides a high-reliable liquid discharge head in which an energy generating element can be protected even when a kogation removal operation is repeated.

According to an aspect of the present invention, a liquid discharge head, contains: an energy generating element which generates thermal energy and contains a heat generation resistant layer containing a material which generates heat by energization and a pair of electrode layers which are used for energizing the heat generation resistant layer and whose end surfaces are separated from each other; an insulating layer covering the pair of electrode layers and the heat generation resistant layer and containing an insulating material; a protective layer provided above the insulating layer at least at a position corresponding to the energy generating element and containing a metal material containing iridium or ruthenium; and a covering layer provided at a position covering at least portions of the protective layer corresponding to the end surfaces of the pair of electrode layers in such a manner that a part of the protective layer is exposed and containing a metal material containing tantalum or niobium.

By providing the constituent elements as described above, even when the kogation removal operation is repeated, portions corresponding to the boundary portions of the protective layer are not eluted. Thus, a destruction of the energy generating element due to cavitation with the tapered portions of the protective layer as the starting point can be prevented.

Further features of the present invention will become apparent from the following description of exemplary embodiments with reference to the attached drawings.

DESCRIPTION OF THE EMBODIMENTS

Figure 1A:
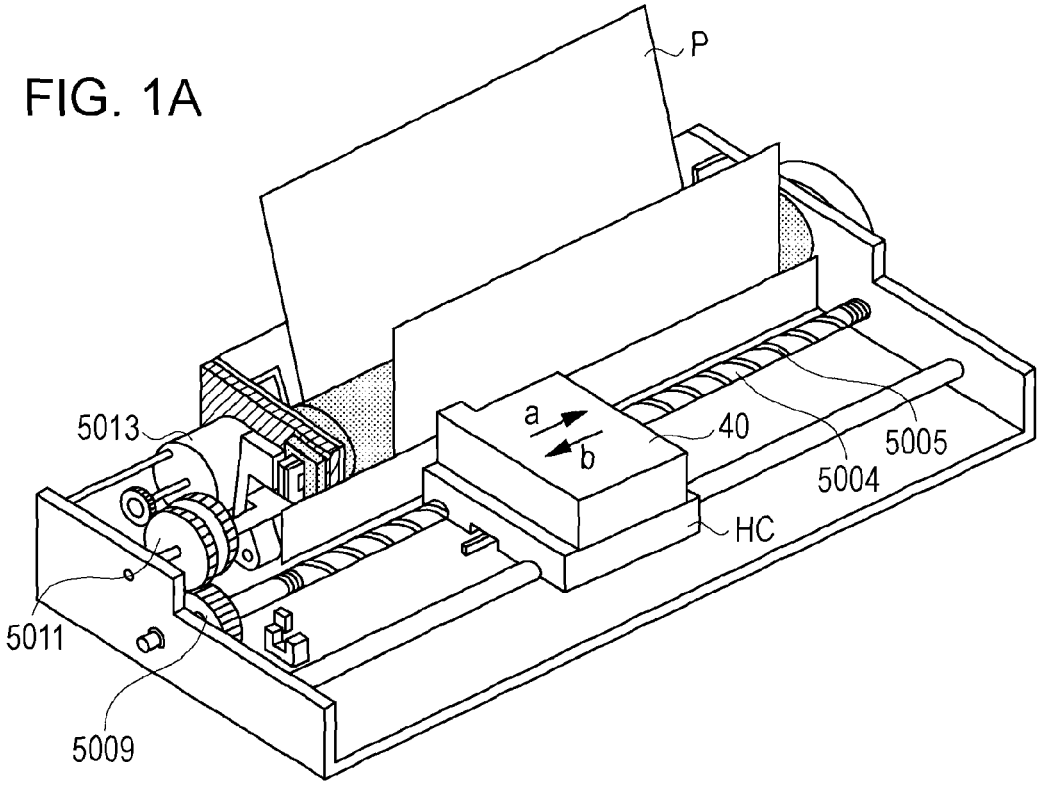
FIG. 1A is a schematic perspective view of a liquid discharge device.

A liquid discharge head can be mounted on devices, such as a printer, a copying machine, a facsimile having a communication system, and a word processor having a printer portion, and also an industrial recording device combined with various processing units in a complex manner. The use of the liquid discharge head allows recording on various recording media, such as paper, thread, fiber, fabric, leather, metal, plastic, glass, wood, and ceramics.

The term "record" as used in this description refers not only to giving images having meanings, such as characters and figures, to a recording medium but to giving images not having meanings, such as patterns, thereto.

The term "liquid" should be widely interpreted and refers to liquid which is given onto a recording medium to be used for the formation of images, designs, patterns, and the like, processing of a recording medium, or treatment of ink or a recording medium. Herein, the treatment of ink or a recording medium refers to treatment for improving fixability by solidifying or insolubilizing a coloring material in ink to be given to a recording medium, improving recording quality and color development properties, and improving image durability, for example. The "liquid" for use in the liquid discharge device of the invention generally has a large amount of electrolytes and has conductivity.

Hereinafter, embodiments of the invention are described with reference to the drawings. In the following description, components having the same function are designated by the same reference numerals throughout the drawings.

Liquid Discharge Device

FIG. 1A is a schematic view illustrating a liquid discharge device capable of carrying a liquid discharge head according to the invention thereon. As illustrated in FIG. 1A, a lead screw 5004 rotates through driving force transmission gears 5011 and 5009 in synchronization with the rotation in forward and reverse directions of a drive motor 5013. A carriage HC can carry a head unit thereon, has a pin (not illustrated) engaging with a spiral groove 5005 of the lead screw 5004, and is moved back and force in the directions indicated by the arrows a and b by the rotation of the lead screw 5004. On the carriage HC, a head unit 40 is mounted.

Head Unit

Figure 1B:
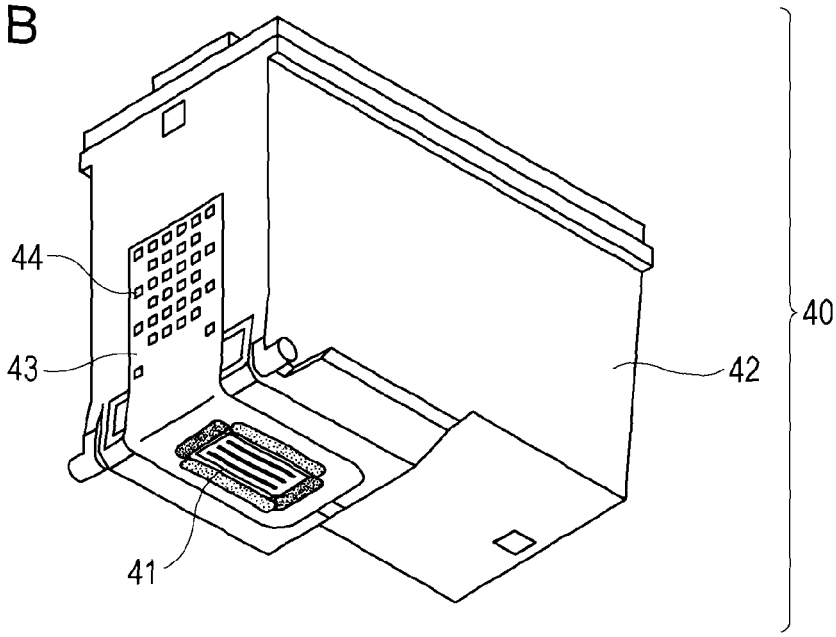
FIG. 1B is a schematic perspective view of a head unit.

FIG. 1B is a perspective view of the head unit 40 which can be mounted on the liquid discharge device as illustrated in FIG. 1A. A liquid discharge head 41 (hereinafter also referred to as a head) is conductive with a contact pad 44 to be connected to the liquid discharge device through a flexible film wiring substrate 43. The head 41 is unified to an ink tank 42 to be integrated therewith to thereby constitute the head unit 40. The head unit 40 described as an example herein is structured so that the ink tank 42 and the head 41 are integrated but can also be structured so that the ink tank is separable.

The invention relates to a liquid discharge head which can be mounted on such a head unit. The invention aims at providing a high-reliable liquid discharge head capable of preventing a breakage of an energy generating element caused by tapered portions corresponding to a level difference of the boundary portions of an electrode layer and a heat generation resistant layer of a protective layer to be used for removing kogation generated when discharging liquid.

Such a liquid discharge head is described below in detail.

First Embodiment

Figure 2:
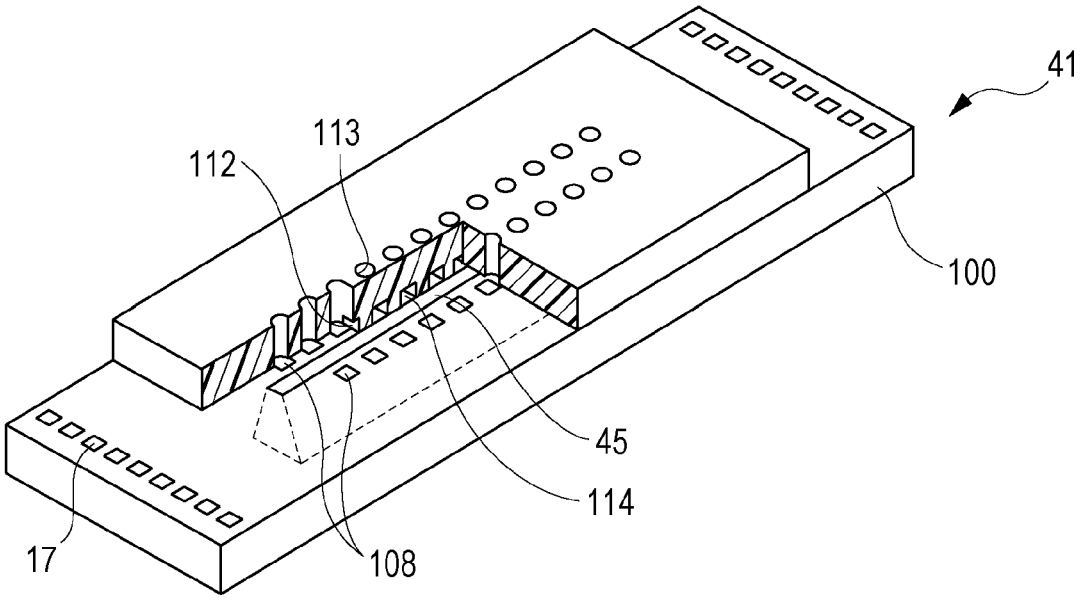
FIG. 2 is a schematic perspective view of a liquid discharge head.

FIG. 2 illustrates a perspective view of the liquid discharge head 41 according to the invention. The liquid discharge head 41 has a substrate 100 for the liquid discharge head having energy generating elements 108 which generate thermal energy to be utilized for discharging liquid and a flow path formation member 112 provided on the substrate 100 for the liquid discharge head. The flow path formation member 112 can be formed with a cured substance of thermosetting resin, such as epoxy resin, and has a plan of discharge ports 113 for discharging liquid and flow paths 114 communicating with the discharge ports 113. By bringing the flow path formation member 112 into contact with the substrate 100 for the liquid discharge head with the plane inside, the flow paths 114 are provided. The discharge ports 113 provided in the flow path formation member 112 are provided in such a manner as to form a line at a predetermined pitch along the supply ports 45. The liquid supplied from the supply ports 45 is transferred to the flow paths 114, and the liquid undergoes film boiling due to thermal energy generated from the energy generating elements 108, so that bubbles are formed. The liquid is discharged from the discharge ports 113 due to the pressure generated at this time, whereby a recording operation is performed. The liquid discharge head 41 further has terminals 17 which are used for electrical connection to the outside, e.g., the liquid discharge device. By supplying a voltage and a signal to the terminals 17 to drive the energy generating elements 108, the liquid can be discharged.

Figure 3A:
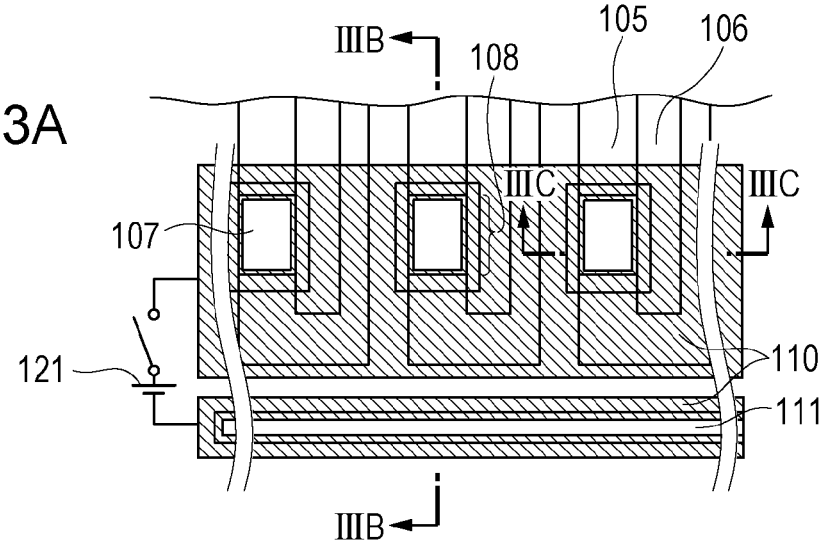
FIG. 3A is a plan schematic view of the neighborhood of an energy generating element of the liquid discharge head.

FIG. 3A is a plan schematic view illustrating, in an enlarged manner, a portion of the energy generating element 108 of the liquid discharge head illustrated in FIG. 2.

When the recording operation is continued for a long period of time by driving such energy generating elements 108, substances, such as a coloring material and an additive, in ink, are heated at a high temperature to be decomposed, changed to a hardly-soluble substance, and then adhere to the heat acting portion on the surface of the energy generating element 108. Such an attached substance is referred to as kogation. When there is such kogation, heat generated by the energy generating elements 108 is not sufficiently transmitted to ink, resulting in a possibility of poor foaming. Therefore, as illustrated in FIG. 3A, a protective layer 107 is provided with a metal material which causes an electrochemical reaction with ink by setting the same as the anode, and then melts in a region corresponding to the heat acting portion for ink of the energy generating element 108. By applying a voltage and applying a current in such a manner that the protective layer 107 serves as the anode in a state where the flow paths 114 of the liquid discharge head are filled with electrolytes, such as ink, the surface of the protective layer 107 causes an electrochemical reaction, and melts. Since the kogation adhering to the surface of the protective layer 107 is also removed with the melting of the surface of the protective layer 107, the thermal energy generated by the energy generating elements 108 can be sufficiently transmitted to ink, so that stable recording can be performed. In this description, such a cleaning operation of the liquid discharge head is referred to as a kogation removal operation. Such a kogation removal operation can be performed as appropriate at required timing based on the kogation adhesion state to the heat acting portion.

Figure 3B:
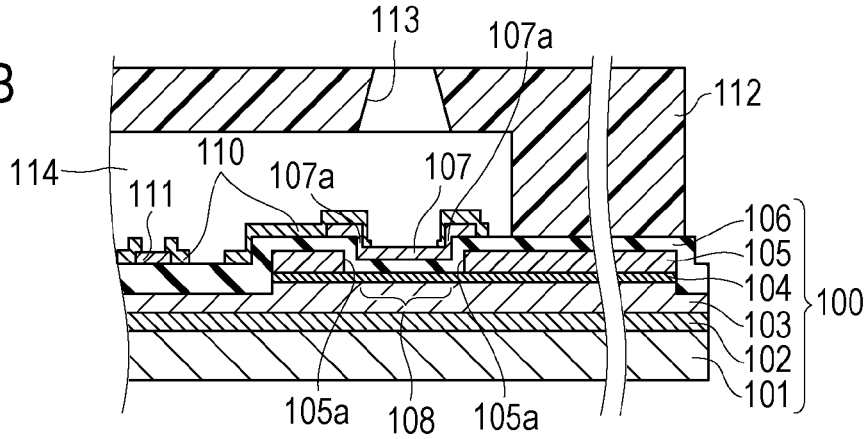
FIG. 3B is a cross-sectional schematic view of a substrate for the liquid discharge head of FIG. 3A along the IIIB-IIIB line.

FIG. 3B is a cross sectional view schematically illustrating the state of the cutting plane when the liquid discharge head 41 is cut perpendicular to the substrate 100 for the liquid discharge head along the IIIB-IIIB line of FIG. 3A.

As illustrated in FIG. 3B, on a base substance 101 containing silicon on which drive elements (not illustrated), such as a transistor, are provided, a thermally-oxidized layer 102 provided by thermally oxidizing a part of the base substance 101 and a thermal storage layer 103 containing a silicon compound, such as $SiO_2$, are provided. On the thermal storage layer 103, a heat generation resistant layer 104 containing a material (e.g., TaSiN and WSiN) which generates heat by energization is provided. Furthermore, a pair of electrode layers 105 containing a conductive material, such as Al, Al—Si, and Al—Cu, having resistance lower than that of the heat generation resistant layer 104 are provided in such a manner as to contact the heat generation resistant layer 104. By supplying a voltage between the pair of electrode layers 105, a portion located between the pair of electrode layers 105 of the heat generation resistant layer 104 is energized to generate heat. Therefore, the portion is used as the energy generating element 108. Although the electrode layers 105 are disposed on the heat generation resistant layer 104 in this embodiment, a configuration such that the heat generation resistant layer is disposed on the pair of electrode layers 105 may be employed.

The heat generation resistant layer 104 and the pair of electrode layers 105 are covered with an insulating layer 106 containing an insulating material, such as a silicon compound, e.g., SiN, in order to achieve insulation with liquid to be discharged, such as ink. Furthermore, a protective layer 107 which is used as a cavitation resistant layer and can perform the kogation removal operation is provided on the insulating layer 106 corresponding to the portion of the energy generating element 108 using a sputtering method or the like. Thus, the energy generating element 108 can be protected from physical impact, such as cavitation due to expansion and contraction of bubbles when discharging, and chemical impact accompanied with heat generation, and further kogation can be removed. Used as a material of such a protective layer 107 is a metal material which causes an electrochemical reaction by applying a potential to set the same as the anode, and then is eluted in ink. Specifically, a platinum group metal material, such as iridium (Ir) and ruthenium (Ru), is mentioned.

The surface of the insulating layer 106 has a convexo-concave shape due to the influence of structures formed under the layer, and particularly portions of the insulating layer corresponding to the level difference of the boundary portions of the heat generation resistant layer 104 and the electrode layer 105 are sharply tapered. The level difference of the boundary portions of the heat generation resistant layer 104 and the electrode layer 105 is formed by a portion, where the electrode layers 105 are not provided, on the heat generation resistant layer 104. Therefore, portions of the insulating layer 106 corresponding to end surfaces 105*a* (FIG. 3B) provided apart from each other of the pair of electrode layers 105 have a tapered shape. When the protective layer 107 is formed using a film formation technique, such as a sputtering method, the film thickness of the protective layer 107 at the tapered portions becomes small. The film quality of the film formed on the tapered shape is lower than the film quality of the film formed on a flat portion. Therefore, an electrochemical reaction easily proceeds. Hereinafter, portions corresponding to the tapered shape of the protective layer 107 are referred to as tapered portions 107*a*. The tapered portions 107*a* are portions formed corresponding to the end surfaces 105*a* of the pair of electrode layers 105.

Figure 7:
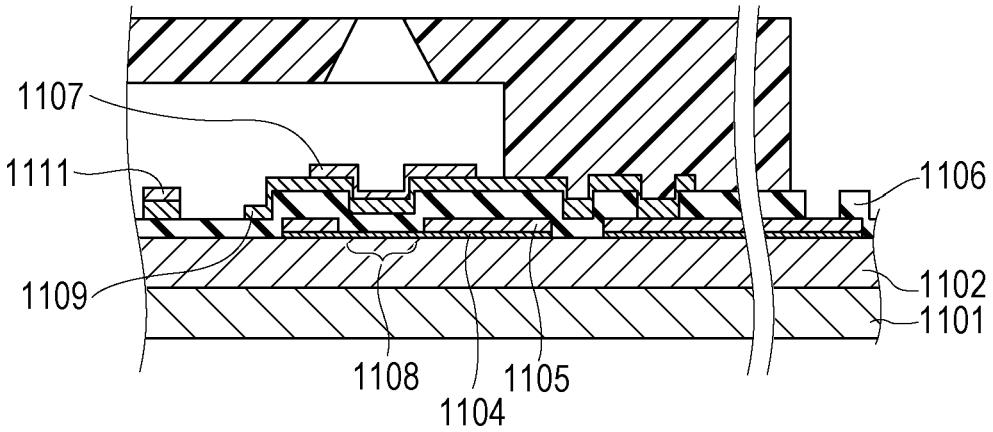
FIG. 7 is a cross-sectional schematic view of a former liquid discharge head.

The tapered portions 107*a* are provided in such a manner as to be covered with a covering layer 110 using a material which is resistant to physical impact, such as cavitation, and chemical impact and does not melt even when energized by applying a voltage or a material which is hard to melt when energized by applying a voltage as compared with the material forming the protective layer 107. By using a metal material, such as tantalum (Ta) and niobium (Nb), as the material of the covering layer 110, the covering layer 110 can also be used as an electrode for applying a voltage. The use of the covering layer 110 also as an electrode eliminates the necessity of providing the electrode layer between the insulating layer and the protective layer as illustrated in FIG. 7. Thus, the distance between the energy generating element 108 and ink is reduced, so that heat generated by the energy generating element 108 can be efficiently transmitted to ink. More specifically, the amount of energy supplied to the energy generating element 108 can also be reduced. Specifically, in the configuration of FIG. 7, the electrode layer is required to have a film thickness of at least about 100 nm. By providing the constituent elements as in the configuration of the invention, the distance of the energy generating element 108 and the heat acting portion can be reduced corresponding to the film thickness of the electrode layer.

As a specific configuration, as illustrated in FIG. 3A, each protective layer 107 can be provided corresponding to the corresponding energy generating element 108 and the covering layer 110 can be provided in such a manner as to cover the tapered portions of the protective layers 107 and to be connected thereto. A counter electrode 111 is further provided in the flow path. By applying a potential difference between the covering layer 110 and the counter electrode 111 described above using, for example, a power supply 121 (a voltage application unit) provided in the liquid discharge device, the kogation removal operation can be performed.

Figure 4:
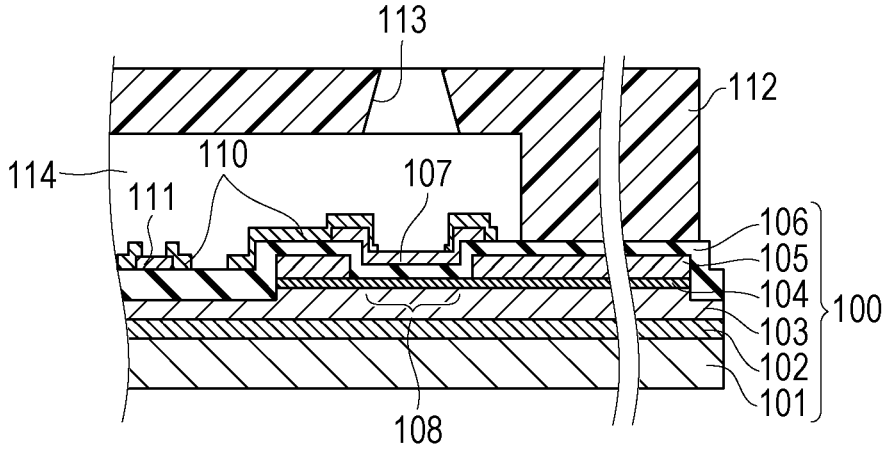
FIG. 4 is a cross-sectional schematic view after performing a kogation removal operation to the liquid discharge head of FIG. 3B.

FIG. 4 illustrates the state of the cross section of the liquid discharge head of FIG. 3B after repeatedly performing the kogation removal operation. The tapered portions 107*a* of the protective layer 107 are covered with the covering layer 110 as illustrated in FIG. 3B, the tapered portions 107*a* do not contact ink even when the kogation removal operation is repeatedly performed. Therefore, even when the kogation removal operation is repeatedly performed, the protective layer 107 in a portion which faces the inside of the flow path disposed on the energy generating element 108 and contacts ink is eluted, but the tapered portions 107*a* are not eluted. Thus, a destruction of the energy generating element 108 due to cavitation with the tapered portions as the starting point can be prevented.

When the kogation removal operation is repeatedly performed, the elution of the protective layer 107 proceeds not only in a direction perpendicular to the substrate but also in a direction horizontal thereto. More specifically, in order not to elute the tapered portions 107*a* of the protective layer 107, it is suitable to provide the covering layer 110 in such a manner that the end portions of the covering layer 110 extend in the inner direction receding from the tapered portions with a distance substantially equivalent to the film thickness of the protective layer from at least the tapered portion. The film thickness of the protective layer 107 refers to the thickness of a portion provided at the position corresponding to the energy generating element 108 of the protective layer 107 and is not covered with the covering layer 110. The same applies in the following description. By also covering the end portions of the protective layer 107 with the covering layer 110, the end portions of the protective layer 107 can also be prevented from separation. By also covering the tapered portions of the insulating layer 106 at the side opposite to the energy generating element 108 of the pair of electrode layers 105, insulation properties can be further increased.

Figure 3C:
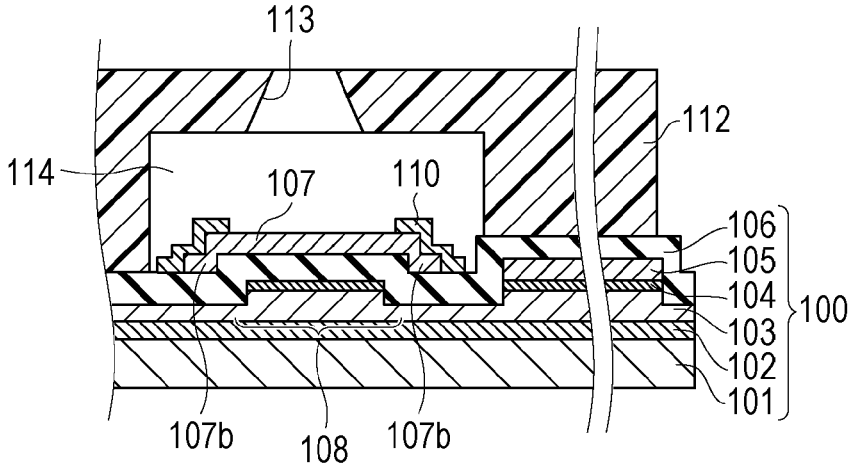
FIG. 3C is a cross-sectional schematic view of the substrate for the liquid discharge head of FIG. 3A along the IIIC-IIIC line.

FIG. 3C is a cross sectional view schematically illustrating the state of the cutting plan when the liquid discharge head 41 is cut perpendicular to the substrate 100 for the liquid discharge head along with the IIIC-IIIC line of FIG. 3A. When patterning the heat generation resistant layer 104 using an etching method, a level difference may arise by the thermal storage layer 103 being over-etched. Such a portion is suitably covered with the covering layer 110 similarly as the tapered portions 107*a* because tapered portions 107*b* of the protective layer 107 with a small film thickness and a bad film quality similarly as the tapered shape formed in the electrode layer 105 are formed. Also in this portion, by providing the covering layer 110 in such a manner that the end portions of the covering layer 110 extend in a direction receding from the tapered portions with a distance equivalent to the film thickness of the tapered portions having a level difference near the energy generating element 108 and the protective layer 107, the tapered portion 107*b* can be protected even when the kogation removal operation is repeatedly performed.

By forming the counter electrode 111 with a material which is not oxidized when applying a voltage in such a manner as to set the same as the anode, e.g., a platinum group, such as iridium and ruthenium, the counter electrode 111 and the protective layer 107 can be alternately set to the anode. When an electrochemical reaction is continued while fixing the counter electrode 111 as the cathode and fixing the protective layer 107 as the anode, there is a case where ink components adhere to the surface of the protective layer 107 serving as the anode depending on the ink to be used, and the elution of the protective layer 107 is hindered, so that kogation cannot be removed. In such a case, by reversing the polarity of the voltage to be applied as appropriate, the kogation removal operation can be performed while removing or dispersing the ink components adhering to the protective layer 107.

By covering the end portions of the counter electrode 111 with a metal material containing tantalum, niobium, or the like, of the covering layer, the elution of the end portions of the counter electrode 111 can be prevented even when the kogation removal operation is performed while reversing the polarity of the voltage to be applied. Thus, even when the kogation removal operation is performed while reversing the polarity of a voltage, a change in the size of the counter electrode 111 can be prevented, and therefore a stable kogation removal operation is achieved.

Manufacturing Method

Next, an example of a method for manufacturing such a liquid discharge head is described.

FIGS. 5A to 5F are cross-sectional schematic views for explaining manufacturing processes of the liquid discharge head illustrated in FIG. 3A.

Figure 5A:
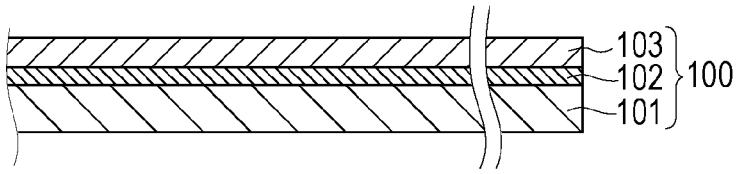
FIGS. 5A to 5F are views for explaining manufacturing processes of a liquid discharge head according to a first embodiment.

On the base substance 101 containing silicon on which drive elements, such as a transistor, are provided, the thermally oxidized layer 102 is provided by thermally oxidizing a part of the base substance 101, and the thermal storage layer 103 containing a silicon compound, such as $SiO_2$, is further provided using a sputtering method or a CVD method (FIG. 5A).

Next, on the thermal storage layer 103, the heat generation resistant layer 104 containing a material (e.g., TaSiN and WSiN) which generate heat by energization is provided with a thickness of about 50 nm by a reactive sputtering method. A conductive material layer of Al, Al—Si, Al—Cu, or the like serving as the pair of electrode layers 105 is formed with a thickness of about 300 nm by a sputtering method. Then, the heat generation resistant layer 104 and the electrode layers 105 are patterned using a photolithographic method and simultaneously using a dry etching method. In this embodiment, a reactive ion etching (RIE) method is used as the dry etching. At this time, it is suitable to sufficiently remove the same using a dry etching method until the surface of the thermal storage layer 103 is over-etched in such a manner that the energy generating elements 108 adjacent to each other are certainly electrically independent.

Figure 5B:
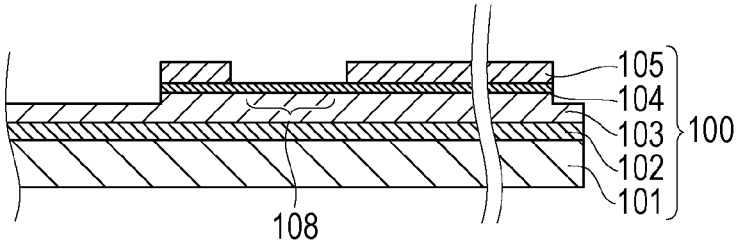

Next, in order to form the energy generating element 108 illustrated in FIG. 5B, a resist mask is provided in such a manner that a portion corresponding to the energy generating element 108 opens using a photolithographic method again, and then the conductive material layer at the opening portion is removed using a wet etching method. Thus, the pair of electrode layers 105 and the heat generation resistant layer 104 having a level difference which constitute the energy generating element 108 are formed.

Figure 5C:
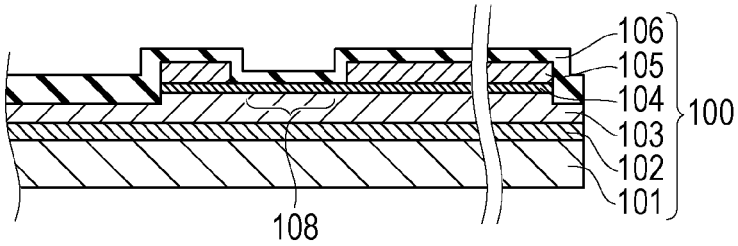
Figure 5D:
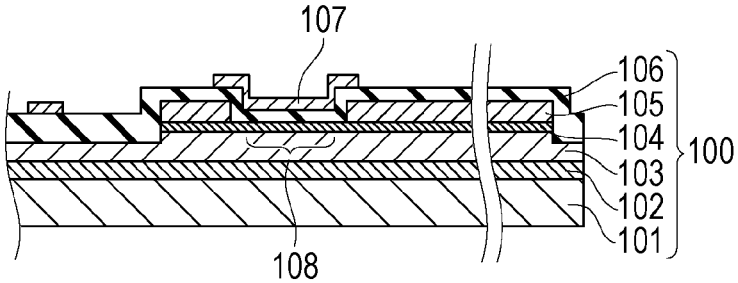

Next, as illustrated in FIG. 5C, a SiN film is formed with a thickness of about 350 nm as the insulating layer 106 at least on portions corresponding to the level difference of the boundary portions of the pair of electrode layers 105 and the heat generation resistant layer 104 and a portion corresponding to the heat generation resistant layer 104 between the pair of electrode layers 105 using a plasma CVD method. At this time, the insulating layer 106 of the portions corresponding to the level difference of the boundary portions of the pair of electrode layers 105 and the heat generation resistant layer 104 has a tapered shape.

Next, a platinum group metal material, such as iridium and ruthenium, which causes an electrochemical reaction by applying a voltage in such a manner as to set the same as the anode and is eluted in ink is formed with a thickness of about 200 nm on the insulating layer 106 by a sputtering method. Thereafter, in order to achieve the shape illustrated in FIG. 5D, dry etching is carried out using the resist mask formed using a photolithographic method, and then patterning is carried out in such a manner as to achieve the pattern of the protective layer 107 covering the energy generating element 108 and the counter electrode 111. At this time, the tapered portions of the protective layer 107 corresponding to the tapered shape of the insulating layer 106 have a small film thickness, and bad film quality.

Next, on the protective layer 107, a metal material containing tantalum, niobium, or the like which has resistance to physical impact, such as cavitation, and chemical impact and does not melt even when energized by applying a voltage is formed into a film using a sputtering method in such a manner that the thickness is about 250 nm. Thereafter, patterning the metal material containing tantalum, niobium, or the like is carried out using a dry etching method or the like in such a manner as to achieve the covering layer 110 which covers the tapered portions 107*a* of the protective layer 107 and the end portions of the protective layer 107 as illustrated in FIG. 5E and is also used as an electrode.

Figure 5E:
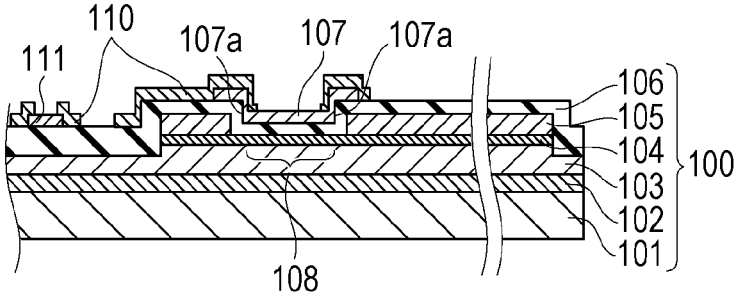

The patterning is suitably performed in such a manner that the covering layer 110 covers portions at the inner side relative to the tapered portions 107*a* with a length almost equivalent to the film thickness of the protective layer 107 as illustrated in FIG. 5E in order to prevent elution of the tapered portions 107*a* of the protective layer 107 even when the kogation removal operation is repeated. Specifically, when the protective layer is provided with a film thickness of about 200 nm, the covering layer 110 is provided in such a manner as to cover a 200 nm portion at the inner side relative to the tapered portions 107. At this time, the covering layer 110 may also be simultaneously patterned in such a manner as to cover an about 200 nm portion of the end portions of the counter electrode 111.

Figure 5F:
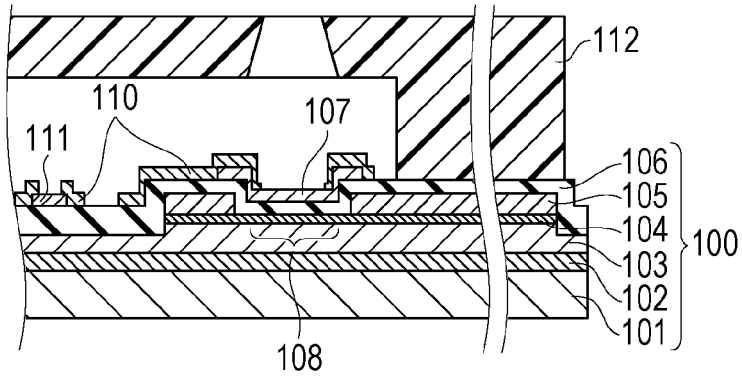

Next, the flow path formation member 112 serving as the plane of the discharge ports 113 for discharging liquid and the flow paths 114 communicating with the discharge ports 113 with a cured substance of thermosetting resin, such as epoxy resin, is provided on the substrate 100 for the liquid discharge head as illustrated in FIG. 5F. By forming the supply port 45 which penetrates the substrate 100 for the liquid discharge head in order to supply ink to the flow paths 114, the liquid discharge head 41 is provided.

When a discharge operation was performed by $1.0\times10^7$ times using such a liquid discharge head 41, stable discharge was not performed depending on the discharge port, e.g., the ink is not discharged in a straight manner and the amount of ink droplets becomes small. When the heat acting portion of the energy generating element 108 corresponding to such a discharge port was observed under an optical microscope, it was confirmed that kogation adheres thereto. When a DC potential difference of 10 V was applied to such a liquid discharge head 41 for 30 sec using the power supply 121 in such a manner that the protective layer 107 serves as the anode, kogation deposited on the protective layer 107 was removed, and a state where stable recording can be performed was restored. Furthermore, when the kogation attaching operation and the kogation removal operation were repeatedly performed by about 30 times, the liquid discharge head 41 was decomposed, and then the liquid discharge head 41 was observed, it was confirmed that the tapered portions 107*a* are protected by the covering layer 110, and are not eluted.

Second Embodiment

In the first embodiment, although the configuration in which the insulating layer 106 and the protective layer 107 are provided in such a manner as to directly contact is described. However, in this embodiment, a configuration in which an adhesion layer 109 for increasing adhesiveness is provided between the insulating layer 106 and the protective layer 107 is described as illustrated in FIG. 6B. Such an adhesion layer 109 is suitably provided using a metal material containing tantalum, chromium, titanium, niobium, and the like or an alloy thereof having good adhesiveness with the insulating layer 106 containing a silicon compound and the protective layer 107 containing a platinum group metal material, such as iridium and ruthenium. The configuration is the same as that of the first embodiment except providing such an adhesion layer 109.

By providing the constituent elements as described above, even when the kogation removal operation is repeatedly performed, the protective layer 107 disposed above the energy generating element 108 and exposed into the flow path is eluted but the tapered portions 107*a* are not eluted. Thus, a breakage of the energy generating element 108 due to cavitation with the tapered portions as the starting point can be prevented. Furthermore, by providing the adhesion layer 109, the protective layer 107 on the insulating layer 106 can be prevented from separation.

By covering the end portions of the protective layer 107 and the adhesion layer 109 with the covering layer 110, the protective layer 107 can also be prevented from separating from the end portions.

Manufacturing Method

Next, an example of a manufacturing method of such a liquid discharge head is described.

Since processes until the insulating layer 106 of FIG. 5C is provided are the same as those of the first embodiment, the description thereof are omitted.

On the insulating layer 106, a material layer serving as the adhesion layer 109 containing a metal material, such as tantalum, chromium, titanium, and niobium, or an alloy thereof and a material layer serving as the protective layer 107 containing a platinum group metal material, such as iridium and ruthenium, are continuously formed into films by a sputtering method. At this time, the material layer serving as the adhesion layer 109 and the material layer serving as the protective layer 107 are continuously formed in such a manner as to achieve a thickness of about 20 nm and about 200 nm, respectively.

Figure 6A:
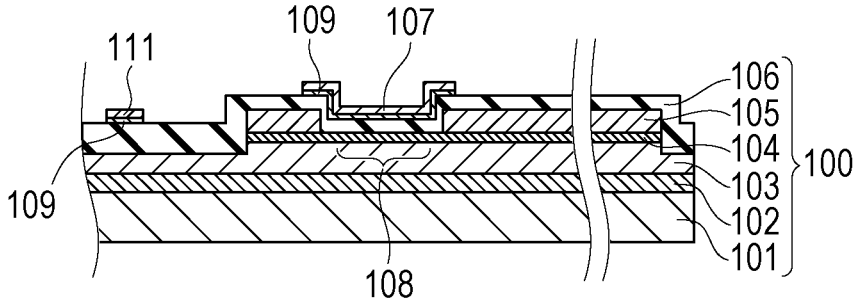
FIGS. 6A to 6C are views for explaining manufacturing processes of a liquid discharge head according to a second embodiment.
Figure 6B:
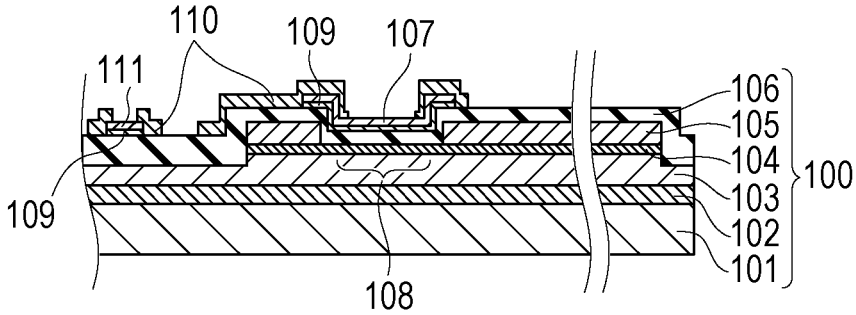

Dry etching is carried out in such a manner as to achieve the shape illustrated in FIG. 6A using a resist mask formed using a photolithographic method, and then patterning is carried out in such a manner as to achieve a pattern of the protective layer 107 covering the energy generating element 108 and the counter electrode 111. At this time, the material layer serving as the adhesion layer 109 is also simultaneously patterned in such a manner as to achieve the same shape, the adhesion layer can be formed.

Next, on the protective layer 107, a metal material containing tantalum, niobium, or the like which has resistance to physical impact, such as cavitation, and chemical impact and does not melt even when energized by applying a voltage is formed into a film using a sputtering method in such a manner that the thickness is about 250 nm. Thereafter, patterning the metal material containing tantalum, niobium, or the like is carried out using a dry etching method or the like in such a manner as to achieve the covering layer 110 which covers the tapered portions 107*a* of the protective layer 107 and the end portions of the protective layer 107 as illustrated in FIG. 6B and is also used as an electrode. Herein, the patterning is suitably performed in such a manner that the covering layer 110 covers portions at the inner side relative to the tapered portions 107*a* with a length almost equivalent to the film thickness of the protective layer 107 as illustrated in FIG. 6B in order to prevent elution of the tapered portions 107*a* of the protective layer 107 even when the kogation removal operation is repeated. Specifically, when the protective layer is provided with a film thickness of about 200 nm, pattering is performed in such a manner that the covering layer 110 covers a 200 nm portion at the inner side relative to the tapered portions 107. At this time, the covering layer 110 may also be simultaneously patterned in such a manner as to cover an about 200 nm portion of the end portions of the counter electrode 111.

Figure 6C:
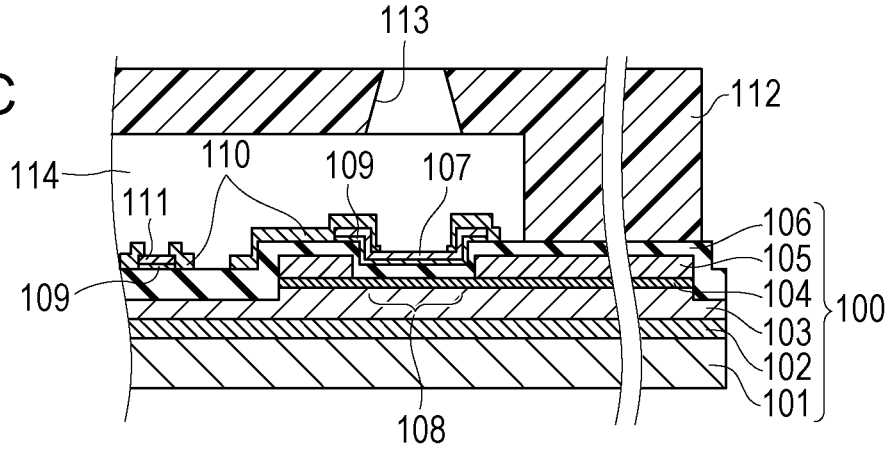

Next, the flow path formation member 112 serving as the plane of the discharge ports 113 for discharging liquid and the flow paths 114 communicating with the discharge ports 113 with a cured substance of thermosetting resin, such as epoxy resin, is provided on the substrate 100 for the liquid discharge head as illustrated in FIG. 6C. The supply port 45 which penetrates the substrate 100 for the liquid discharge head in order to supply ink to the flow paths 114 is formed.

By manufacturing as described above, the liquid discharge head 41 capable of performing the kogation removal operation can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-267153 filed Dec. 6, 2011, which is hereby incorporated by reference herein in its entirety.

What is claimed is:

1. A liquid discharge head, comprising:

an energy generating element which generates thermal energy and contains a heat generation resistant layer containing a material which generates heat by energization and a pair of electrodes which are used for energizing the heat generation resistant layer and whose end surfaces are separated from each other;

an insulating layer covering the pair of electrodes and the heat generation resistant layer and containing an insulating material;

a protective layer provided above the insulating layer at least at a position corresponding to the energy generating element and containing a metal material containing iridium (Ir) or ruthenium (Ru); and a covering layer covering at least portions of the protective layer corresponding to the end surfaces of the pair of electrodes, being provided at a position where the covering layer overlaps a part of the energy generating element in a direction in which the layers are stacked and containing a metal material containing tantalum (Ta) or niobium (Nb).

2. The liquid discharge head according to claim 1, wherein a peripheral portion of the protective layer provided at the position corresponding to the energy generating element is covered with the covering layer and a portion inside the peripheral portion of the protective layers is exposed.

3. The liquid discharge head according to claim 1, wherein the portions of the protective layer have a tapered shape.

4. The liquid discharge head according to claim 1, wherein a distance of the portions of the protective layer and end portions of the covering layer provided at the position corresponding to the energy generating element is equal to or larger than a thickness of the exposed part of an protective layer.

5. The liquid discharge head according to claim 1, wherein the covering layer covers end portions of the protective layer.

6. The liquid discharge head according to claim 1, wherein an adhesion layer is provided between the insulating layer and the protective layer.

7. The liquid discharge head according to claim 6, wherein the adhesion layer is formed with a metal material containing at least one of tantalum (Ta), chromium (Cr), titanium (Ti), and niobium (Nb).

8. A liquid discharge device, comprising:

the liquid discharge head according to claim 1; and an application unit applying a voltage in such a manner that the protective layer serves as an anode to liquid.

9. A liquid discharge head, comprising:

an energy generating element which generates thermal energy and contains a heat generation resistant layer containing a material which generates heat by energization and a pair of electrodes which are used for energizing the heat generation resistant layer and whose end surfaces are separated from each other;

an insulating layer covering the pair of electrodes and the heat generation resistant layer and containing an insulating material;

a protective layer provided above the insulating layer at least at a position corresponding to the energy generating element and containing a material which is eluted by an electrochemical reaction with liquid; and a covering layer provided at a position covering at least portions of the protective layer corresponding to the end surfaces of the pair of electrodes in such a manner that a part of the protective layer is exposed and containing a material which is not eluted by an electrochemical reaction with liquid.

10. The liquid discharge head according to claim 9, wherein the covering layer is formed with a metal material containing tantalum (Ta) or niobium (Nb).

11. The liquid discharge head according to claim 10, wherein the protective layer is formed with a metal material containing iridium (Ir) or ruthenium (Ru).

12. The liquid discharge head according to claim 9, wherein a peripheral portion of the protective layer provided at the position corresponding to the energy generating element is covered with the covering layer and a portion inside the peripheral portion of the protective layers is exposed.

13. The liquid discharge head according to claim 9, wherein the portions of the protective layer have a tapered shape.

14. The liquid discharge head according to claim 9, wherein a distance of the portions of the protective layer and end portions of the covering layer provided at the position corresponding to the energy generating element is equal to or larger than a thickness of the exposed part of the protective layer.

15. The liquid discharge head according to claim 9, wherein the covering layer covers end portions of the protective layer.

16. The liquid discharge head according to claim 9, wherein an adhesion layer is provided between the insulating layer and the protective layer.

17. The liquid discharge head according to claim 16, wherein the adhesion layer is formed with a metal material containing at least one of tantalum (Ta), chromium (Cr), titanium (Ti), and niobium (Nb).

18. A liquid discharge device, comprising:

the liquid discharge head according to claim 9; and an application unit applying a voltage in such a manner that the protective layer serves as an anode to liquid.

19. The liquid discharge head according claim 9, wherein the covering layer is provided at a position where the covering layer overlaps a part of the energy generating element in a direction in which layers are stacked.

* * * * *